US006850551B1

(12) United States Patent
Eckert

(10) Patent No.: US 6,850,551 B1
(45) Date of Patent: Feb. 1, 2005

(54) ELECTRIC HEATER FOR MOLTEN ALUMINUM

(76) Inventor: C. Edward Eckert, 260 Lynn Ann Dr., New Kensington, PA (US) 15068

( * ) Notice: Subject to any disclaimer, the term of this patent is extended or adjusted under 35 U.S.C. 154(b) by 3 days.

(21) Appl. No.: 10/633,483

(22) Filed: Aug. 4, 2003

(51) Int. Cl.[7] ..... H05B 3/60

(52) U.S. Cl. ..... 373/42; 219/523; 219/553; 266/217; 373/133

(58) Field of Search ..... 373/42, 111, 117, 373/133, 134; 219/523, 534, 535, 544, 553; 392/497, 503; 266/200, 217, 242; 430/112

(56) References Cited

U.S. PATENT DOCUMENTS 3,793,015 A * 2/1974 Van Engeland et al. .... 430/112
5,120,027 A * 6/1992 Pelton ..... 266/242
5,494,265 A * 2/1996 Ventre ..... 266/217
5,850,072 A * 12/1998 Eckert ..... 219/523
5,963,580 A * 10/1999 Eckert ..... 373/42
6,069,910 A * 5/2000 Eckert ..... 373/42

* cited by examiner

*Primary Examiner*—Tu Hoang
(74) *Attorney, Agent, or Firm*—Andrew Alexander

(57) ABSTRACT

An electric heater assembly suitable for heating molten metal, the electric heater assembly having a sleeve comprised of a closed end suitable for immersing in the molten metal. The sleeve is fabricated from a composite material comprised of titanium alloy and having an outside surface to be exposed to the molten metal coated with a refractory resistant to attack by the molten metal having a sealant metal applied thereto; and an electric heater located in the sleeve in heat transfer relationship therewith.

22 Claims, 2 Drawing Sheets

ELECTRIC HEATER FOR MOLTEN ALUMINUM

BACKGROUND OF THE INVENTION

This invention relates to electric heaters, and more particularly, it relates to electric heaters suitable for use in molten metals such as molten aluminum.

In the prior art, electric heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tube is fragile and subject to cracking. Thus, there is a great need for an improved electric heater suitable for use with molten metal, e.g., molten aluminum, which is efficient in transferring heat to the melt. The present invention provides such an electric heater and provides a refractory coating resistant to attack by the molten aluminum.

SUMMARY OF THE INVENTION

It is an object of the invention to provide an improved electric heater assembly.

It is another object of the invention to provide an improved electric heater assembly for use in molten metal such as molten aluminum.

Yet, another object of this invention is to provide an improved electric heater assembly for use in molten metal, the electric heater assembly having a protective sleeve that has intimate physical contact with the heating element, thereby substantially elminating the air gap between the heater and sleeve.

And yet, another object of the invention is to provide an improved electric heater assembly for use in molten metal, the electric heater assembly having a protective sleeve having a thermal conductivity of less than 30 BTU/ft hr° F. and having a thermal expansion coefficient of less than $15\times10^{-6}$ in/in/° F. and having a chilling power of less than 5000 $BTU^2/ft^4$ hr° F.

And yet, it is a further object of the invention to provide an improved electric heater assembly for use in molten metal, the electric heater assembly having a protective sleeve comprised of a material resistant to erosion or dissolution by molten metal such as molten aluminum.

These and other objects will become apparent from the specification, drawings and claims appended hereto.

In accordance with these objects, there is disclosed an improved electric heater assembly suitable for heating molten metal. The electric heater assembly is comprised of a tube having a closed end suitable for immersing in molten metal, the tube fabricated from a composite material comprised of a metal case having a coefficient of thermal expansion of less than $10\times10^{-6}$ in/in/° F. The refractory coating has a metal sealant applied thereto, the metal sealant oxidized to provide an oxidized metal sealant in pores of the refractory coating. The oxidized metal sealant in combination with the refractory coating is resistant to attack by the molten metal.

The invention also includes a method of forming an electric heater suitable for heating molten metal wherein the electric heater is comprised of a tube having a closed end for immersing in the molten metal. The tube is comprised of a composite material. The method of forming the electric heater comprises the steps of providing a metal tube having a coefficient of thermal expansion less than $8\times10^{-6}$ in/in/° F. and having an outside surface. A bond coat is applied to the outside surface and a refractory coating is applied to the bond coat. A metal sealant is applied to the refractory coating and then the metal sealant is oxidized to provide a metal sealant resistant to reaction by said molten metal. An electric heating means is located in the tube.

DETAILED DESCRIPTION OF THE PREFERRED EMBODIMENTS

Figure 1:
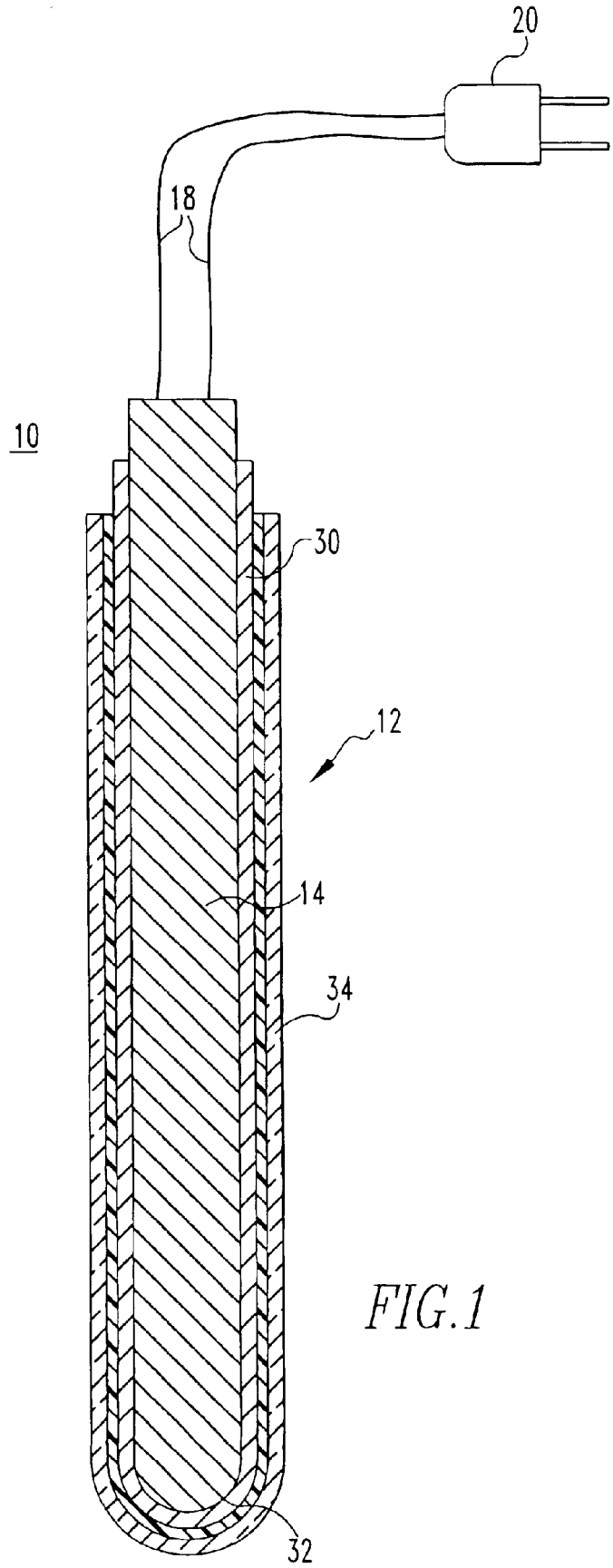
FIG. 1 is a cross-sectional view of an electric heater assembly in accordance with the invention.

Referring to FIG. 1, there is shown a schematic of an electric heater assembly 10 in accordance with the invention. The electric heater assembly is comprised of a protective sleeve 12 and an electric heating element 14. A lead 18 extends from electric heating element 14 and terminates in a plug 20 suitable for plugging into a power source. A suitable element 14 is available from International Heat Exchanger, Inc., Yorba Linda, Calif. 92687 under the designation P/N HTR2252.

Preferably, protective sleeve 12 is comprised of titanium tube 30 having a closed end 32. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30. Electric heating element 14 is seated or secured in tube 30 by any convenient means. For example, swagelock nuts and ferrules may be employed or the end of the tube may be crimped or swaged shut to provide a secure fit between the electric heating element and tube 30. In the invention, any of these methods of holding the electric heating element in tube 30 may be employed. It should be understood that tube 30 does not always have to be sealed. In a preferred embodiment, electric heating element 14 is inserted into tube 30 to provide an interference or friction fit. That is, it is preferred that electric heating element 14 has its outside surface in contact with the inside surface of tube 30 to promote heat transfer through tube 30 into the molten metal. Thus, air gaps between the surface of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from titanium.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiF (364 NiFe) and NiTiC (40 Ni 60TiC), particularly when such materials have low thermal expansion and low chilling power, all referred to herein as metals. For protection purposes, it is preferred that the metal or metalloid be coated with a material such as a refractory resistant to attack by molten metal and suitable for use as a protective sleeve.

Further, the material of construction for tube 30 should have a thermal conductivity of less than 30 BTU/ft hr° F., and preferably less than 15 BTU/ft hr° F., with a most preferred material having a thermal conductivity of less than 10 BTU/ft hr° F. Another important feature of a desirable material for tube 30 is thermal expansion. Thus, a suitable material should have a thermal expansion coefficient of less than $15\times10^{-6}$ in/in/° F., with a preferred thermal expansion coefficient being less than $10\times10^{-6}$ in/in/° F., and the most preferred being less than $5\times10^{-6}$ in/in/° F. Another important feature of the material useful in the present invention is chilling power. Chilling power is defined as the product of heat capacity, thermal conductivity and density. Thus, preferably the material in accordance with the invention has a chilling power of less than 5000 $BTU^2/ft^4$ hr° F., preferably less than 2000 $BTU^2/ft^4$ hr° F., and typically in the range of 100 to 750 $BTU^2/ft^4$ hr° F.

As noted, the preferred material for fabricating into tubes 30 is a titanium base material or alloy having a thermal conductivity of less than 30 BTU/ft hr° F., preferably less than 15 BTU/ft hr° F., and typically less than 10 BTU/ft hr° F., and having a thermal expansion coefficient less than $15\times10^{-6}$ in/in/° F., preferably less than $10\times10^{-6}$ in/in/° F., and typically less than $5\times10^{-6}$ in/in/° F. The titanium material or alloy should have chilling power as noted, and for titanium, the chilling power can be less than 500, and preferably less than 400, and typically in the range of 100 to 300 $BTU/ft^2$ hr° F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The titanium-base alloy can be a titanium selected from the group consisting of 6242, 1100 and commercial purity (CP) grade. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 A, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 A' 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material, which provides the tube with a molten metal resistant coating. The refractory coating can vary, depending on the molten metal. Thus, a novel composite material is provided permitting use of metals or metalloids having the required thermal conductively and thermal expansion for use with molten metal, which heretofore was not deemed possible.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The refractory coating may be sealed to provide additional protection against penetration of molten metal, e.g., molten aluminum that will react with metal tube 30. Thus, in yet another aspect of the invention, a sealant agent such as magnesium oxide may be intruded into the pores or micro cracks in refractory coating 34. The actual sealant agent may be directly intruded, such as magnesium oxide particulate, or result from an in-situ reaction that occurs within the pores or micro cracks. A necessary condition for direct intrusion of a sealant agent is that the particle size of the agent is less than the effective diameter of the pore or discontinuity. Available sealant agents due to these size incompatibilities cannot necessarily intrude pores or micro cracks with an exceptionally small effective diameter. It has been found that certain liquids or even vapors can easily intrude pores or micro cracks without being limited by size. These liquids or vapors may not be acceptable as a sealant agent, alone, however, they can be reacted or transformed in the pore or micro crack itself to become an acceptable agent. An example of such a transformed sealant is magnesium oxide that originated as magnesium metal and was transformed to the oxide within the pore or micro crack. In the case of magnesium, it can be intruded into the refractory coating, subjected to an oxidation process to form the oxide, e.g., magnesium oxide, of the intruded metal to provide a compound such as magnesium oxide that is resistant to attack by molten metal such as molten aluminum.

Any process that intrudes the sealant metal into the pores of refractory coating 34 may be used. For example, the refractory coated tube may be dipped in molten magnesium to intrude metal into the pores. Excess metal adhering to refractory coating 30 is removed leaving only metal intruded in the pores.

In another method, sputtering of a metal onto the refractory coating and into the pores can be used.

In yet another method, a form of vapor deposition may be used to intrude the metal. The refractory coated tube is placed in a retort in such a manner as to seal the outside diameter of the tube to the atmosphere, while allowing access to the inside diameter of the tube. Under an inert gas backfill, e.g., argon, the retort is heated above the melting point of the metal being intruded, e.g., about 1200° F. for magnesium. The argon atmosphere is removed and a vacuum is applied sufficient to vaporize the molten magnesium in the retort at that particular temperature. At this point, the tube is internally cooled to a temperature sufficient to permit condensation of magnesium vapor. This temperature can be obtained by using an equation of the form:

$$\ln P = -A/T + B,$$

where: P=absolute pressure $A,B$=constants for specific metal

T=absolute temperature

In the case of magnesium, this equation becomes:

$$\ln P(mm\ Hg) = -15829/T(^\circ K) + 17.99$$

Figure 2:
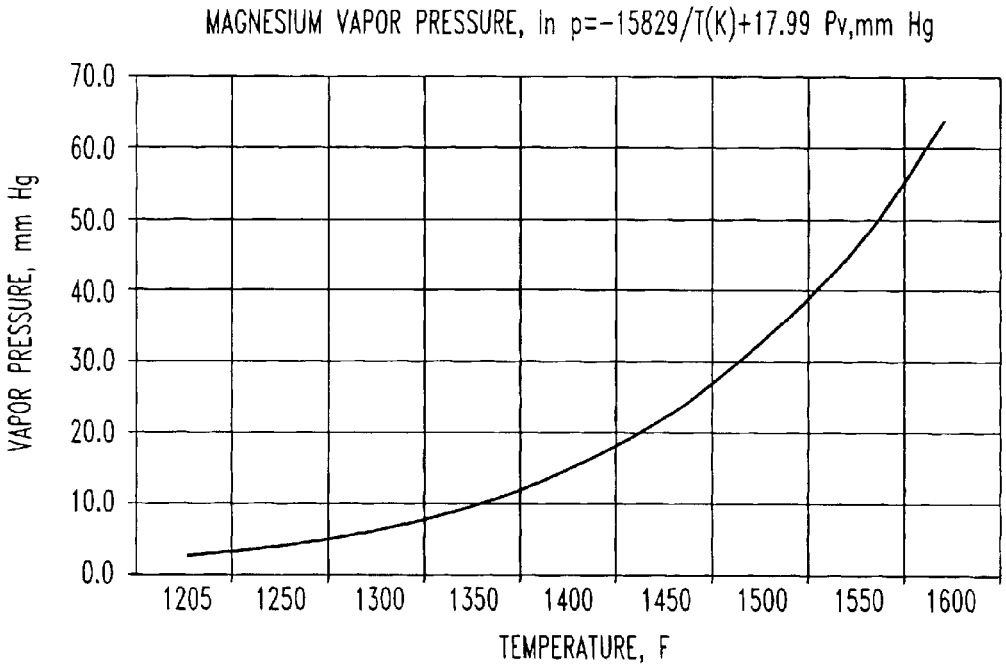
FIG. 2 is a curve of Mg vapor versus temperature.

This equation is represented in graphical form in FIG. 2 that becomes an operating curve for a magnesium retort. Successful magnesium vaporization requires the maintenance of a temperature/pressure condition that falls under the illustrated curve.

An air jet or air/fluid mist directed inside the tube can be used for this purpose. The vaporized magnesium condenses out on the refractory coating and within the pores and micro cracks. Thereafter, the intruded magnesium is oxidized. Any process that transforms the intruded magnesium metal to magnesium oxide may treat the magnesium. For example, a thermal conversion process can be used where the refractory coated tube is heated in an air furnace to convert the intruded magnesium metal to magnesium oxide. The tube should be heated to a temperature of at least 600° F. for a minimum duration of 30 minutes to form magnesium oxide. Metals other than magnesium a can be used for this purpose, provided that it will form an oxide that is resistant to attack by molten metal, such as aluminum. In the thermal conversion method, it is also necessary for the oxide formed by this metal to be incoherent and be able to grow to completion.

The refractory coating has also been shown to develop improved resistance to molten metal, e.g., molten aluminum, by subjecting it to a specific thermal practice. It is believed that heating the refractory coated tube prior to immersion in molten metal develops micro cracks that help to accommodate thermally induced mechanical stresses. If these micro cracks develop after the tube is exposed to molten metal, failure may occur if the molten metal is permitted to react with the bond coat that would now become exposed as a result of the micro cracks. Allowing the micro cracks to develop before molten metal exposure and subsequently sealing the micro cracks has been shown to improve resistance of the refractory coating to molten metal. Sealing can be accomplished by one of the previously described methods. An additional method can be used if the bond coating can be converted to a material resistant to attack by molten metal. In cases where the bond coat consists of elements that can form stable and resistant oxides, a thermal treatment sufficient to produce such oxides may be used. Other conversion treatments to form stable reaction products (e.g., nitrides and/or carbides) with the bond coat are possible with the appropriate atmosphere. In all cases, however, such treatment must be performed after the formation of micro cracks. In the case of exposure to molten aluminum, a bond coat material containing aluminum, chromium, and/or titanium can be pre-oxidized by heating to an elevated temperature following the formation of micro cracks. It can be shown that cyclic heating and cooling of the tube will further encourage micro crack formation. Still further, it can be shown that heating the tube internally from the interior wall, rather than through the exterior, will promote micro crack formation and development.

The following practice has been shown to be beneficial in the case of a refractory coated tube that is intended to be exposed to molten aluminum. Such a tube will use a bond coat material that preferably contains yttrium, and/or chromium, and/or aluminum. Following application of the refractory top coating, the tube is heated to 1350° F. from within using an inserted cartridge heater. Micro cracks are permitted to form. The tube is then cooled to a temperature of 500° F., and then reheated to 1350° F., followed by cooling. This thermal cycle may be repeated for three total cycles. Then, the tube is held at a temperature of 900° F. in air to allow stable oxides of yttrium, chromium, and aluminum to form. The oxides formed by this process provide significantly improved resistance to molten metal attack. Temperatures that may be used are those sufficient to form stable oxides from the element(s) in the bond coat, for example, 400° to 2200° F.

The heater assembly of the invention can operate at watt densities of 40 to in excess of 140 watts/in$^2$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath inside diameter provides for substantial elimination of an annular air gas between heating element and sheath. In prior heaters, the annular air gap resulted in radiation heat transfer and also backs radiation to the element from inside the sheath wall, which limits maximum heat flux. By contrast, the heater of the invention employs an interference fit that results in essentially only conduction.

In conventional heaters, the heating element is not in intimate contact with the protection tube resulting in an annular air gas or space there between. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 40 to 120 watts/in$^2$. The low coefficient of expansion of the composite sheath, which is lower than the heating element, provides for intimate contact of the heating element with the composite sheath.

In another feature of the invention, a thermocouple (not shown) may be inserted between sleeve 12 and heating element 14. The thermocouple may be used for purposes of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

While the invention has been described in terms of preferred embodiments, the claims appended hereto are intended to encompass other embodiments, which fall within the spirit of the invention.

What is claimed is:

1. A method of forming an electric heater suitable for heating molten metal, the electric heater comprised of a tube having a closed end for immersing in the molten metal, the tube comprised of a composite material, the method comprising the steps of:

(a) providing a tube having a coefficient of thermal expansion less than $8\times10^{-6}$ in/in/° F. and having an outside surface;

(b) applying a bond coat to the outside surface;

(c) applying a refractory coating to said bond coat;

(d) applying a metal sealant to said refractory;

(e) converting said metal sealant to provide a transformed metal sealant resistant to reaction by said molten metal; and (f) locating an electric heating means in said tube.

2. The method in accordance with claim 1 including applying said metal sealant by vapor deposition.

3. The method in accordance with claim 1 including applying said metal sealant by immersing in molten metal sealant.

4. The method in accordance with claim 1 wherein said metal tube is fabricated from a metal selected from the group consisting of titanium, titanium alloys, stainless steel, nickel based alloys and iron based alloys.

5. The method in accordance with claim 1 wherein said bond coating comprises an alloy selected from the group consisting of Cr—Ni—Al alloy, a Cr—Ni—Al—Y alloy and a Cr—Ni alloy.

6. The method in accordance with claim 1 wherein said refractory coating is selected from the group consisting of one of $Al_2O_3$, $ZrO_2$, $Y_2O_3$ stabilized $ZrO_2$, SiAlON and $Al_2O_3$—$TiO_2$.

7. The method in accordance with claim 1 wherein said metal sealant is selected from the group consisting of Mg, Al, Zn, Ca and Y.

8. The method in accordance with claim 1 wherein said oxidized metal sealant is magnesium oxide.

9. The method in accordance with claim 1 including converting the said metal sealant to a metal oxide.

10. An electric heater assembly suitable for immersion heating molten metal, the electric heater assembly comprised of a tube having a closed end suitable for immersing in molten metal, the tube fabricated from a composite material comprised of a case having a coefficient of thermal expansion of less than $10\times10^{-6}$ in/in/° F. and having an outer surface coated with a refractory coating having a coefficient of thermal expansion less than $10\times10^{-6}$ in/in/° F.;

the refractory coating having a metal sealant applied thereto, the metal sealant oxidized to provide an oxidized metal sealant in pores of the refractory coating, the oxidized metal sealant resistant to attack by said molten metal.

11. The electric heater in accordance with claim 10 wherein the metal case is selected from a metal selected from the group consisting of titanium, titanium alloys, stainless steel, nickel based alloys and iron based alloys.

12. The method in accordance with claim 10 wherein said metal sealant is selected from the group consisting of Mg, Al, Zn, Ca and Y.

13. The method in accordance with claim 10 wherein said oxidized metal sealant is magnesium oxide.

14. A method of forming an electric heater suitable for heating molten metal, the electric heater comprised of a tube having a closed end for immersing in the molten metal, the tube comprised of a composite material, the method comprising the steps of:

(a) providing a metal tube having a coefficient of thermal expansion less than $8\times10^{-6}$ in/in/° F. and having an outside surface;

(b) applying a bond coat to the outside surface;

(c) applying a refractory coating to said bond coat;

(d) heating said refractory coating to cause formation of micro cracks and to form oxides of metals comprising said bond coat and metal tube in said micro cracks to render said refractory coating resistant to corrosive attack by said molten metal; and (e) locating an electric heating means in said tube.

15. The method in accordance with claim 14 including heating said coating to a temperature range of 400° to 2200° F.

16. The method in accordance with claim 14 wherein said metal tube is fabricated from a metal selected from the group consisting of titanium, titanium alloys, stainless steel, nickel based alloys and iron based alloys.

17. The method in accordance with claim 14 wherein said bond coating comprises an alloy selected from the group consisting of Cr—Ni—Al alloy, a Cr—Ni—Al—Y alloy and a Cr—Ni alloy.

18. The method in accordance with claim 14 wherein said refractory coating is selected from the group consisting of one of $Al_2O_3$, $ZrO_2$, $Y_2O_3$ stabilized $ZrO_2$, SiAlON and $Al_2O_3$—$TiO_2$.

19. An electric heater assembly suitable for immersion heating molten metal, the electric heater assembly comprised of a tube having a closed end suitable for immersing in molten metal, the tube fabricated from a composite material comprised of a metal case having a coefficient of thermal expansion of less than $10\times10^{-6}$ in/in/° F. and having an outer surface coated with a refractory coating having a coefficient of thermal expansion less than $10\times10^{-6}$ in/in/° F.;

the refractory coating oxidized by heating in a temperature range of 400° to 2200° F. to provide an oxidized metal in micro cracks of the refractory coating, the oxidized metal rendering the refractory coating resistant to attack by said molten metal.

20. The electric heater in accordance with claim 19 wherein the metal case is selected from the group consisting of titanium, titanium alloys, stainless steel, nickel based alloys and iron based alloys.

21. The method in accordance with claim 19 wherein said refractory coating is selecting from the group consisting of one of $Al_2O_3$, $ZrO_2$, $Y_2O_3$ stabilized $ZrO_2$, SiAlON and $Al_2O_3$—$TiO_2$.

22. The method in accordance with claim 19 wherein said bond coating comprises an alloy selected from the group consisting of Cr—Ni—Al alloy, a Cr—Ni—Al—Y alloy and a Cr—Ni alloy.

* * * * *